US005317117A

United States Patent [19]

Bruski et al.

[11] Patent Number: 5,317,117

[45] Date of Patent: May 31, 1994

[54] GAS DEFLECTION AND ISOLATION SYSTEM FOR USE WITH A HIGH POWER CIRCUIT BREAKER

[75] Inventors: Gary P. Bruski, Washington County; Chester Malkowski, Jr., Milwaukee County, both of Wis.

[73] Assignee: Allen-Bradley Co., Inc., Milwaukee, Wis.

[21] Appl. No.: 984,051

[22] Filed: Nov. 30, 1992

[51] Int. Cl.[5] ..... H01H 33/00; H01H 9/30

[52] U.S. Cl. ..... 200/144 R

[58] Field of Search ..... 200/144 R, 147 R, 304, 200/305, 306; 335/201, 202

[56] References Cited

U.S. PATENT DOCUMENTS

| | | | |
|---|---|---|---|
| 4,620,076 | 10/1986 | Mrenna et al. | 200/304 |
| 4,650,940 | 3/1987 | Grunert et al. | 200/144 R |
| 4,654,490 | 3/1987 | Leone et al. | 200/144 R X |
| 4,982,174 | 1/1991 | Fasano | 335/201 |

*Primary Examiner*—J. R. Scott

*Attorney, Agent, or Firm*—John J. Horn; H. Frederick Hamann

[57] ABSTRACT

A system for directing the ionized gases which can exit from the vent openings of the arc chambers in high power circuit breakers away from the line terminals of the circuit breaker and isolating these terminals from infiltration by such gases. The system includes a deflection plate, interphase barriers and end plates mounted in proximity to the vent openings and around the line terminals.

11 Claims, 1 Drawing Sheet

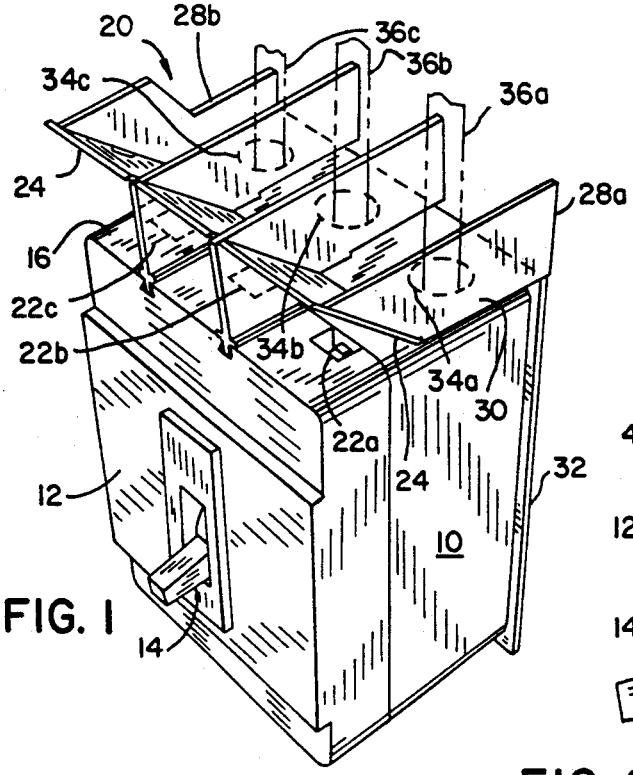
FIG. 1
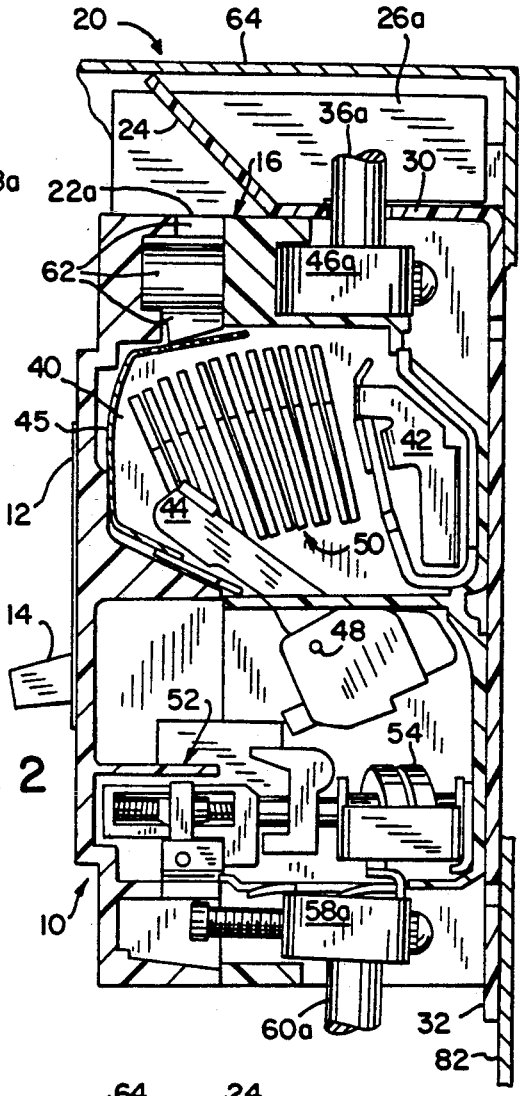
FIG. 2
FIG. 3
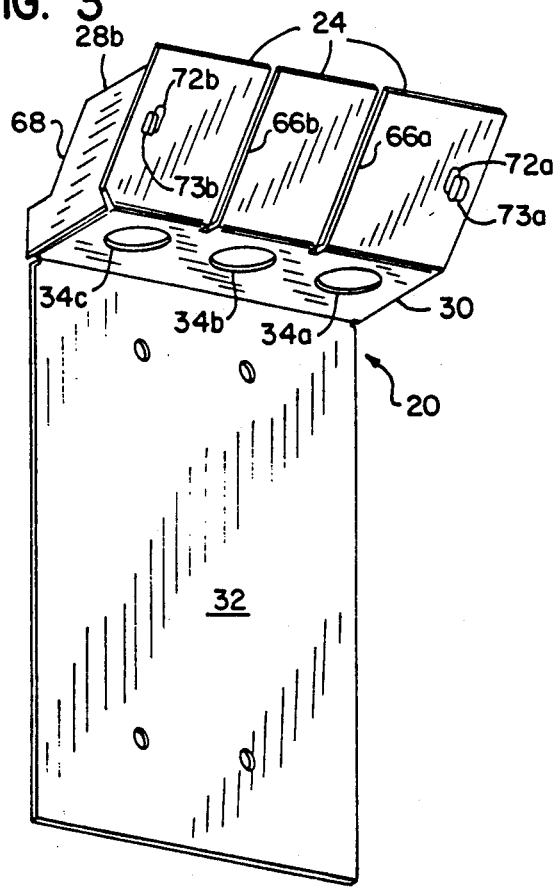
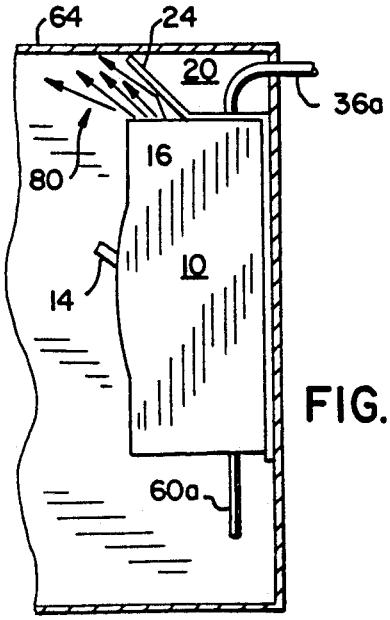
FIG. 4

GAS DEFLECTION AND ISOLATION SYSTEM FOR USE WITH A HIGH POWER CIRCUIT BREAKER

BACKGROUND OF THE INVENTION

The present invention relates to high power electrical circuit breakers and more particularly to systems for preventing direct electrical conduction and uncontrolled arcing between the line connection terminals of such circuit breakers or between these line connection terminals and electrical ground.

High power circuit breakers generally include arc chambers located inside the circuit breakers in which controlled arcing frequently occurs as electrical connectivity is broken between the contact members of the circuit breaker. Especially under short circuit fault conditions this arcing produces large amounts of hot ionized gases within the arc chambers which exit from these chambers through vent openings in the top of the circuit breaker. Unfortunately, if these ionized gases collect in the vicinity of the line terminals of the circuit breaker they may establish a conduction path between terminals connected to different phases of the line current or between the terminals and electrical ground. This can lead to massive electrical faults on the line sides of the circuit breakers and can result in the destruction of the equipment. This can be a troublesome problem with conventional high power circuit breakers which position the vent openings to the arc chambers within the circuit breaker along the top of the circuit breaker in proximity to the line terminals.

It is therefore an object of the present invention to provide a system for a high power circuit breaker which can direct ionized gases which escape from the vent openings in the circuit breaker away from the line terminals and prevent such gases from collecting in the vicinity of the line terminals.

It is another object of the present invention to provide a deflection system for deflecting hot ionized gases exiting the vent openings to the arc chambers of a high power circuit breaker forward of the circuit breaker and away from the line terminals and electrical ground.

It is a further object of the present invention to isolate the spaces in proximity to the line terminals of a high power circuit breaker from each other and from areas adjacent to the top of the circuit breaker so that ionized gases cannot infiltrate into those spaces and establish conduction paths between the different line terminals.

It is yet another object of the present invention to provide a system for deflecting the ionized gases which may escape from the vent openings of a high power circuit breaker away from its line terminals and electric ground which is inexpensive and may be conveniently installed in conjunction with the mounting of the circuit breaker within a conventional control center.

SUMMARY OF THE INVENTION

The present invention constitutes a deflection and isolation system for use in conjunction with a high power circuit breaker having vent openings which allow the escape of ionized gas from arc chambers within the circuit breaker. The deflection system includes a deflection plate, a pair of interphase barriers and a pair of end plates which serve to deflect ionized gases forward of the circuit breaker away from the circuit breaker's line terminals and isolate spaces in proximity to the line terminals from adjacent areas.

In the preferred embodiment, the present invention is adapted for use with a three phase circuit breaker having a horizontally inclined top which includes three laterally adjacent vent openings connected to the three arc chambers corresponding to the three phases of current handled by the circuit breaker. The deflection plate extends forward and upwardly from in between the vent openings and line terminals on the top surface of the circuit breaker so as to be able to direct gases exiting the vent openings forward of the circuit breaker and away from the line terminals and electrical ground. The interphase barriers extend between the line terminals upwardly from the top of the circuit breaker so as to isolate the spaces around the line terminals from each other. The end plates extend along opposite sides of the circuit breaker parallel with the interphase barriers as to isolate the space along the top of the circuit breaker around the line terminals from areas laterally adjacent to the circuit breaker. The deflection and isolation system is attached to a bracket plate which extends behind the circuit breaker for mounting the system onto the back and top of the circuit breaker. In operation, when electrical connectivity between contact members within the arc chamber is broken arcing occurs, the resulting hot ionized gases which escape from the vent openings are deflected forward of the circuit breaker by the deflection plate and isolated from collecting in the vicinity of the line terminals and electrical ground by the end plates and interphase barriers.

BRIEF DESCRIPTION OF THE DRAWINGS

FIG. 1 provides an elevated prospective view of a circuit breaker including the deflection and isolation system of the present invention.

FIG. 2 provides a cross-sectional view of a high power circuit breaker showing a single contact assembly, arc chamber, vent passage and vent opening associated with one of the three phases of electrical current handled by the circuit breaker.

FIG. 3 provides a prospective view of the deflection plate, end plates, support plate and bracket plate of the present invention in isolation from the circuit breaker.

FIG. 4 provides a side view of a high power circuit breaker including the present invention in operation for intercepting ionized gases exiting vent openings in the top of the circuit breaker and deflecting these gases forward of the circuit breaker.

DESCRIPTION OF THE PREFERRED EMBODIMENT

Referring now to FIG. 1, a high power circuit breaker 10 is housed in a casing having a vertically inclined front 12 on which a switch lever 14 is mounted for manually operating or resetting the circuit breaker 10 and a horizontally inclined top 16 on which the deflection and isolation system 20 of the present invention is installed. The top 16 of the circuit breaker 10 includes three laterally adjacent vent openings *22a*, *22b* and *22c* (*22b* and *22c* are shown in phantom) which connect to arc chambers within the circuit breaker 10. The system 20 is installed along the top 16 of the circuit breaker 10 and includes a deflection plate 24, a pair of interphase barriers *26a* and *26b* and a pair of end plates *28a* and *28b*. The deflection plate 24 is attached to a support plate 30 which extends along the rearward surface of the top 16 of the circuit breaker 10 and is attached to a bracket plate 32 which runs along the back of the circuit breaker 10. The deflection plate 24, support plate 30, end plates 28*a* and 28*b* and bracket plate 32 are constructed from a single sheet of polycarbonate plastic while the interphase barriers 26*a* and 26*b* are made of insulating rubber. The support plate 30 includes openings 34*a*, 34*b* and 34*c* (in phantom) through which the line connection wires 36*a*, 36*b* and 36*c* (in phantom) can pass down into the circuit breaker 10 for connection with the line terminals of the circuit breaker 10 which are recessed along the rearward side of the top 16 of the circuit breaker 10. The deflection plate 24 intersects the top 16 at an acute angle of about 45 degrees and is positioned to intercept gases escaping from vent openings 22*a*, 22*b* and 22*c* at an acute angle and deflect these gases forward of the circuit breaker 10 and away from the line terminals and electrical ground at the rear of the top 16 of the circuit breaker 10.

Referring now to FIG. 2, a typical contact assembly includes a stationary contact 42 and a movable contact 44 which are mounted in an arc chamber 40. The stationary contact 42 is connected to one of the line terminals 46*a* to which the line connection wire 36*a* is in turn secured. The movable contact 44 is coupled to a load terminal 58*a* and is configured for rotation around an axis 48 whereby contact can be made and broken with the stationary contact 42. As electrical connectivity is broken between the contacts 42 and 44, the movable contact 44 translates past the arc chutes 50 which help separate and break up electrical arcs between the contacts 42 and 44. A perforated baffle 45 of insulating material helps protect the inside of the arc chamber 40 but does not block gas flow into the passage 62. An electromagnetic trip mechanism 52 is operated by a coil 54 for moving the movable contact 44 away from the stationary contact 42 and automatically breaking electrical connectivity between these contacts whenever a current overload takes place. The load terminal 58*a* is mounted at the bottom of the circuit breaker 10 for receiving a load connection wire 60*a* and is in turn connected through the coil 54 to the movable contact 44.

Whenever electrical contact is broken between the movable contact 44 and the stationary contact 42 and especially under short circuit fault conditions, arcing results in the chamber 40 whereby hot ionized gases are produced which seek to escape from the chamber 40. The passage 62 extends upward from the arc chamber 40 to the top 16 of the circuit breaker 10 and provides a path for hot ionized gases to exit from the chamber 40 through the vent opening 22*a*. The deflection plate 24 helps direct these gases forward of the circuit breaker 10 and away from the line terminal 46*a* and electrical ground. Further, a top plate 64 of sheet metal which may comprise part of a motor control center or control cabinet 82 in which the circuit breaker 10 is mounted, extends horizontally over the system 20 so as to cover the system 20 and further isolate the line terminal 46*a* from exposure to gases which may escape from the vent opening 22*a*.

Referring now to FIG. 3, deflection plate 24 is divided into three sections by the slots 66*a* and 66*b* which allow the interphase barriers 26*a* and 26*b* to pass through the plate 24 as they are mounted into grooves in the top 16 of the circuit breaker 10. The deflection plate 24 comprises an extension of the support plate 30 which runs along the rearward section of the top 16 of the circuit breaker 10 and includes openings 34*a*, 34*b* and 34*c* through which the connection wires coupled to the line terminals can pass. The end plates 28*a* and 28*b* extend vertically upward along the opposite lateral sides of the circuit breaker 10 at right angles with the deflection plate 24 for further isolating the spaces around the line terminals from areas adjacent to the circuit breaker. The end plate 28*b* includes a notch through which wiring can pass laterally to one side if required for proper installation of the circuit breaker 10. The bracket plate 32 connects to the rearward edge of the support plate 30 for securing the deflection system to the circuit breaker 10 and isolating the circuit breaker 10 from the back plate of the control center in which it may be mounted. The deflection plate 24 may also include small apertures 72*a* and 72*b* through which projections 73*a* and 73*b* attached to the forward edges of end plates 28*a* and 28*b* may pass and be secured for providing rigidity to the system 20 and insuring that the end plates 28*a* and 28*b* are properly positioned with respect to the deflection plate 24.

Referring now to FIG. 4, in operation, ionized gases 80 escaping from the vent openings in the forward part of the top 16 the circuit breaker 10 are deflected by the deflection plate 24 forward of the circuit breaker 10 and away from the line terminals which are located along the rearward part of the top 16 of the circuit breaker 10. The deflection plate 24, end plates 28*a* and 28*b*, interphase barriers 26*a* and 26*b* and top plate 64 prevent the ionized gases from collecting in the vicinity of the line terminals where they might provide a conduction path between the line terminals or the line terminals and electrical ground which could cause arcing to develop between the line terminals and result in damage to the circuit breaker 10 and/or surrounding equipment.

While particular embodiments of the present invention have been shown and described, it should be clear that changes and modifications may be made to such embodiments without departing from the true scope and spirit of the invention. It is intended that the appended claims cover all such changes and modifications.

We claim:

1. In a three-phase circuit breaker having a front, having a top on which three line terminals are mounted and having three separate contact assemblies including stationary contacts which are connected to said line terminals, movable contacts and multiple arc chutes located in separate arc chambers which are upwardly vented through separate passages connecting said chambers to separate vent openings in the top of said breaker which are positioned forward of said line terminals, the improvement comprising:

a gas deflector including a deflection plate which extends forward and upward from between said vent openings and said line terminals on the top of said circuit breaker over but spaced apart at an angle from said vent openings so as to deflect any gas escaping from said chambers through said passages forward of said circuit breaker and away from said line terminals and electrical ground.

2. The circuit breaker of claim 1, further including a pair of vertically inclined interphase barriers extending upwardly from the top of said breaker in between adjacent line terminals so as to form barriers between said terminals and a pair of vertically inclined end plates extending upwardly from opposite lateral sides of the top of said circuit breaker so as to isolate the space around said line terminals from areas adjacent to said circuit breaker.

3. The circuit breaker of claim 2, further including a horizontally inclined planar top plate covering said deflection plate, said interphase barriers and said end plates on top of said circuit breaker.

4. The circuit breaker of claim 1, wherein said deflection plate intersects the top of said circuit breaker at an angle of approximately 45 degrees.

5. A three-phase circuit breaker having a vertically inclined front on which a switching lever is mounted and a horizontally inclined top, said circuit breaker including:

three laterally adjacent contact assemblies, each assembly comprising:

a. a line terminal mounted on the top of said breaker, b. an arc chamber located inside said breaker, c. a stationary contact mounted in said arc chamber, d. a movable contact mounted in said arc chamber, and e. a passage connecting said arc chamber to a vent opening located on the top of said breaker forward of said line terminal; and a gas deflector comprising a deflection plate which extends forward and upward from between the vent openings of said contact assemblies and the line terminals of said contact assemblies on the top of said circuit breaker over but spaced apart at an angle from said vent openings so as to deflect any gas escaping from said arc chambers of said contact assemblies through said passages of said contact assemblies forward of said circuit breaker and away from said line terminals.

6. The circuit breaker of claim 5, further including a pair of vertically inclined interphase barriers extending upwardly from the top of said breaker in between adjacent line terminals so as to form barriers between said terminals and a pair of vertically inclined end plates extending upwardly from the side edges of the top of said circuit breaker to further isolate the space around said line terminals from any gas which may escape from said vent openings.

7. The circuit breaker of claim 5, further including a horizontally inclined planar top plate covering said deflection plate.

8. The circuit breaker of claim 5, wherein said deflection plate intersects the top of said circuit breaker at an angle of approximately 45 degrees.

9. The circuit breaker of claim 5, further including a bracket plate mounted behind said circuit breaker and attached to said deflection plate for securing said deflection plate in position on said top of said circuit breaker and isolating said circuit breaker from the backplate on which it is mounted.

10. A device for isolating the vent openings for venting the arc chambers of a high power circuit breaker from its line terminals so that any ionized gases which may escape from said vent openings as electrical contact is broken between contact members in said arc chambers are directed away from said line terminals, comprising:

a gas deflection plate positioned in proximity to and in between said vent openings and line terminals for separating said openings from said line terminals and inclined so as to intercept any gases exiting from said openings at an acute angle and deflect such gases away from said line terminals;

a pair of interphase barriers extending from front to back across the top of said circuit breaker and positioned in between said line terminals for isolating said terminals from each other;

a pair of end plates positioned at right angles to said deflection plate and parallel to said interphase barriers on opposite lateral sides of said line terminals and circuit breaker for isolating said line terminals from adjacent areas alongside said circuit breaker; and a top plate for covering said deflection plate, said interphase barriers and said end plates and further isolating said line terminals from adjacent areas.

11. The device of claim 10, wherein said deflection plate is comprised of polycarbonate plastic material.

* * * * *